US007251939B2

(12) United States Patent
Walker

(10) Patent No.: US 7,251,939 B2
(45) **Date of Patent: *Aug. 7, 2007**

(54) GENERAL METHOD FOR DISPOSAL OF PRODUCED WATER

(76) Inventor: Weldon Eugene Walker, 30234 Live Oak Trail, Georgetown, TX (US) 78628

( * ) Notice: Subject to any disclaimer, the term of this patent is extended or adjusted under 35 U.S.C. 154(b) by 0 days.

This patent is subject to a terminal disclaimer.

(21) Appl. No.: 11/230,082

(22) Filed: Sep. 19, 2005

(65) Prior Publication Data

US 2006/0005969 A1 Jan. 12, 2006

Related U.S. Application Data

(63) Continuation-in-part of application No. 10/822,497, filed on Apr. 12, 2004, now Pat. No. 6,971,238.

(51) Int. Cl.
*F03G 7/00* (2006.01)

(52) U.S. Cl. ..... 60/641.2; 60/670

(58) Field of Classification Search ..... 60/641.2, 60/641.3, 641.4, 641.5, 670
See application file for complete search history.

(56) References Cited

U.S. PATENT DOCUMENTS 3,563,210 A * 2/1971 Hoogendam ..... 122/1 B
3,744,565 A * 7/1973 Brown ..... 166/267
3,950,137 A * 4/1976 Larson et al. ..... 422/81
4,341,636 A * 7/1982 Harder et al. ..... 210/662
4,577,102 A * 3/1986 Sherman et al. ..... 250/269.2
4,619,769 A * 10/1986 Gritters et al. ..... 210/747
4,710,367 A * 12/1987 Wong et al. ..... 423/335
5,128,042 A * 7/1992 Fenton ..... 210/642
5,414,743 A * 5/1995 Batheja et al. ..... 376/299
6,971,238 B1 * 12/2005 Walker ..... 60/641.2
2003/0141228 A1 * 7/2003 Vazquez Perez et al. .. 210/96.1

* cited by examiner

*Primary Examiner*—Hoang Nguyen
(74) *Attorney, Agent, or Firm*—Larry Mason Lee; Steven W. Smith

(57) ABSTRACT

A method and apparatus useful for disposing of the high volumes of produced water associated with coal bed methane natural gas wells. The method taught is to create steam from the produced water and vent the steam into the atmosphere. The apparatus taught utilizes available heat energy sources to produce heat for enhancing water evaporation rates and may incorporate a pre-heater system and/or a mineral separation system.

6 Claims, 3 Drawing Sheets

GENERAL METHOD FOR DISPOSAL OF PRODUCED WATER

CROSS REFERENCE TO RELATED APPLICATIONS

The present application is a continuation-in-part of U.S. patent application Ser. No. 10/822,497, filed Apr. 12, 2004, now U.S. Pat. No. 6,971,238 by Weldon Walker.

BACKGROUND OF THE INVENTION

The present invention is related generally to methods of disposing of wellhead water separated from the production flow of gaseous hydrocarbons flowing out of a producing well. The present invention is further related generally to apparatus useful in methods of disposing of wellhead water which has been separated from the production flow of gaseous hydrocarbons flowing out of a producing natural gas well. More specifically, the present invention is related to devices and apparatus which create and discharge into the atmosphere steam created from the heating of fresh water separated from the flow of gaseous hydrocarbons available at the output of a natural gas producing well.

Many gaseous hydrocarbon producing wells lift large quantities of water along with the gaseous hydrocarbons from the well. Particularly this is true in the gas fields of Wyoming. This wellhead water is troublesome in that it must be separated from the gaseous hydrocarbons being produced and it must be disposed of in an environmentally friendly fashion.

There are several prior art methods of disposing of the fresh water pumped from the collection pond. One method used very often is to pump the water back into a disposal well. Disposal wells are attempts to put the fresh water pumped from the collection pond back into the geologic structure from whence it came. The gaseous hydrocarbon production wells in Wyoming are shallow wells, usually 300 to 1500 foot deep. The disposal well is typically deeper and of greater bore than a gaseous hydrocarbon production well. Several gaseous hydrocarbon production wells are usually served by a single disposal well.

Another method of disposing of the water pumped from the collection pond is to simply pump the water into a groundwater runoff region wince it can flow in a stream merging with natural water flows in the region and area of the producing wells.

Yet another method of disposing of the water pumped from the collection pond is to pump the water into an additional storage pond, either natural or artificial, where the water can be allowed to evaporate into the atmosphere.

A fourth prior art method of disposing of the water pumped from the collection pond is to spread the water over the surface of the surrounding land in a form of irrigation. This dispersion of the water over the surface of the surrounding land relies upon the rate of evaporation of the water from the surface of the land for the rate at which the water which can be disposed of. Additionally, various methods of treating the water being dispersed or of treating the land onto which the water is being dispersed are known to improve the rate of water disposal through irrigation techniques.

The instant invention is of a method of disposing of the water from a collection pond or storage tank by creation of steam and discharge of the steam into the atmosphere and of the apparatus utilized to create that steam and discharge it into the atmosphere.

Numerous boilers and steam generating apparatus are taught by the prior art. All of such boilers and steam generating apparatus are deficient in one or more particulars for the task accomplished by the instant invention.

There are several problems with the prior art relative to devices and apparatus to generate steam, relative to use in a method of disposing of the water from the collection pond by creation of steam and discharge of the steam into the atmosphere. In particular, it is noted that the apparatus of the prior art is directed toward more efficient steam generation, toward creation of maximum energy steam at the lowest cost in heat energy and water feed. The apparatus of the instant invention is not an efficient generator of steam energy. The apparatus of the instant invention discharges spent steam into the atmosphere. The goal of the instant invention is to discharge the greatest possible quantity of moisture, in the form of steam, into the atmosphere. The instant invention is deliberately inefficient in its use of water to create steam. The more water used, the better.

The are also several problems with the prior art methods of disposing of the fresh water pumped from the collection pond of a producing gaseous hydrocarbon well into disposal wells.

The problems encountered with disposal wells arise because these wells are injection wells, operated under high pressure and thus such wells are different in kind from the wells in the field of gaseous hydrocarbon wells that produce the fresh water that needs to be disposed of. Usually, therefore, the disposal wells are not located in the same geology as are the producing wells. Transport of the produced fresh water to the disposal wells becomes a problem, an insurmountable economic problem if it is necessary to utilize trucks to transport the fresh water to the site of the disposal wells. This is the case in the Powder River Basin field of gaseous hydrocarbon wells in Wyoming.

The problems encountered with pumping the produced freshwater into a groundwater runoff region is that the produced freshwater sometimes carries substantial quantities of mineral impurities which can act to poison the groundwater and therefore this method of disposal has been banned in most jurisdictions in the United States.

The problems encountered with the utilization of additional water storage tanks, either natural or artificial, is that actual disposal of the fresh water produced depends on the rate of evaporation from the additional water storage tanks. This rate of evaporation acts as a cap on the rate of production of gaseous hydrocarbons from the wells, an economically unacceptable cap.

The problems encountered with use of irrigation as a method of disposal of produced fresh water primarily are created by the local geography in the Wyoming gas fields. In those fields, and areas adjoining the fields, there is a layer of clay at or near the surface of the soil. The clay precludes absorption of the fresh water into the ground at any meaningful rate. This method is used commonly, but its success is limited to the rate of evaporation of the produced fresh water into the atmosphere that, as above-mentioned, is an unacceptable economic cap on the production from the wells.

SUMMARY OF THE INVENTION

In brief summary, the present invention is of a method of disposing of the fresh water from the collection pond or holding tank for the output of a gaseous hydrocarbon producing well by creation of steam and discharge of the steam into the atmosphere. The instant invention is additionally of the apparatus specifically designed to practice such method and utilized to create and discharge the steam created from the fresh water from the collection pond or holding tank for the output of a gaseous hydrocarbon producing well.

Injecting produced water into disposal wells has been used in oil and gas fields as a standard disposal method for decades. These wells require governmental permits and are strictly monitored. Drilling a successful well is difficult at best and sometimes not possible. This seems to be the case in some of the natural gas fields of the Rocky Mountain region. The problem seems to be that the tight geological formation simply prevents water injection. One of the few successful disposal methods is an irrigation system, however this system is expensive, labor intensive, and weather conditions limit use to six to eight months of the year. The temporary solution is to build more earth storage ponds as a means to continue production. The U.S. Department of Energy's case study report concludes that more than 39 trillion cubic feet of coalbed methane gas is technically recoverable. Actual production will depend on the success of the chosen water disposal method.

Several problems have been noted in prior art and the instant invention was developed to overcome such known problems. Accordingly, it is a general object of this invention to provide a method of disposing of the produced fresh water from the gaseous hydrocarbon wells that does not require use of disposal wells or transportation of the fresh water out of the gaseous hydrocarbon production fields.

It is another object of this invention is to provide a method of disposing of the produced fresh water from the gaseous hydrocarbon wells that does not depend on the rate of evaporation of the produced fresh water into the atmosphere.

It is yet another object of this invention is to provide a method of disposing of the produced fresh water from the gaseous hydrocarbon wells that does not depend on the rate of absorption of the produced fresh water into the ground.

It is a yet further and final object of this invention is to provide an apparatus useful in the practice of a method of disposing of the produced fresh water from the gaseous hydrocarbon wells that creates steam and discharges that steam into the atmosphere.

Other objects and advantages of the present invention will be apparent upon reading the following description and appended claims.

Description of the Numeric References

| No. | Description |
|---|---|
| 10 | Apparatus of the instant invention |
| 11 | High Efficiency Evaporator |
| 20 | Water Storage Tank and Gathering System |
| 40 | Well and Wellhead |
| 50 | Natural Gas Production Line |
| 51 | Input Fuel Line |
| 52 | Second Input Fuel Line |
| 100 | Wellhead Production System using Steam Disposal of produced fresh water |
| 111 | Fluid Communication Line from the Water Storage Tank to the Input Water Flow Meter of the Apparatus of the Instant Invention |
| 112 | Fluid Communication Line from the Input Water Flow Meter to the Filtering System |
| 113 | Fluid Communication Line from the Water Filtering System to the High Efficiency Evaporator |
| 113a | Fluid Communication Line from Water Filtering System to the Pre-heater |

-continued

Description of the Numeric References

| No. | Description |
|---|---|
| 113b | Fluid Communication Line from Pre-heater to High Efficiency Evaporator |
| 114 | Heat Energy Source |
| 120 | Fluid Communication Line from the Production Wellhead to the Water Storage Tank |
| 130 | Input Water Flow Meter |
| 150 | Water Filtering System |
| 160 | Pre-heater |
| 170 | Mineral Separator System |
| 196 | Evaporated Water Output Line |
| 197 | De-Mineralized Evaporated Water Output Line |

DESCRIPTION OF THE DRAWINGS

While the novel features of the instant invention are set forth with particularity in the appended claims, a full and complete understanding of the invention can be had by referring to the detailed description of the preferred embodiment(s) which is set forth subsequently, and which is as illustrated in the accompanying drawings, in which:

DESCRIPTION OF THE PREFERRED EMBODIMENT(S)

Figure 1:
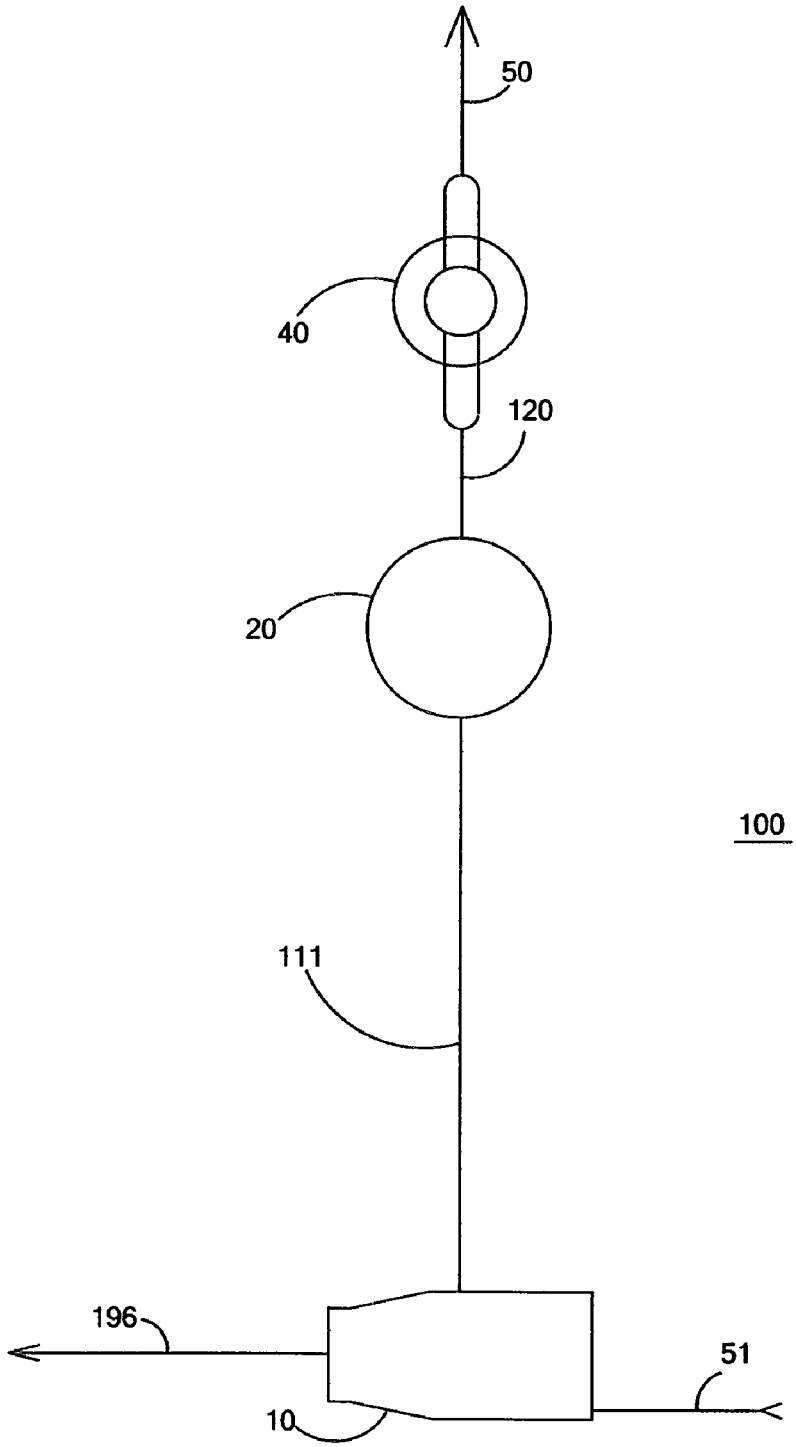
FIG. 1 is a block diagram of a system 100 practicing the method of the instant invention.

As is seen by reference to FIG. 1, the instant invention is of a method of disposing of the produced fresh water communicated 111 from the water storage tank 20 for the output of a gaseous hydrocarbon producing well 40 by creation of steam in the apparatus of the instant invention 10 and discharge of the steam through the evaporated water output line 196 into the atmosphere. The instant invention is additionally of the apparatus 10 specifically designed to practice such method and utilized to create and discharge the steam created from the water which was communicated 111 from the water storage tank and gathering system 20 at the output of a gaseous hydrocarbon producing well 40.

FIG. 1 is a block diagram of a system which practices the method of the instant invention and depicts the apparatus 10 of the instant invention in flow position relative to the other major components of the system 100. The system 100 comprises a gaseous hydrocarbon producing well and wellhead 40 which is in fluid communication with a water storage tank and gathering system 20 via the fluid communication line 120. The gaseous hydrocarbon producing well and wellhead 40 also has a natural gas output which is depicted as output via natural gas flow line 50. The water storage tank and gathering system 20 is in fluid communication 111 with the input to the apparatus 10. The other outputs of the apparatus 10 are steam via the steam flow line 105 and electrical power via the electrical power production line 25. Thus, the system 100 is seen to have two outputs: natural gas via the natural gas flow line 50 and steam via the evaporated water output line 196; and the system 100 is shown to have but a single input, the input fuel line 51. The apparatus 10 of the instant invention utilizes the water input by fluid communication 111 from the water storage tank 20 to create steam which is output via the evaporated water output line 196 into the atmosphere.

Figure 2:
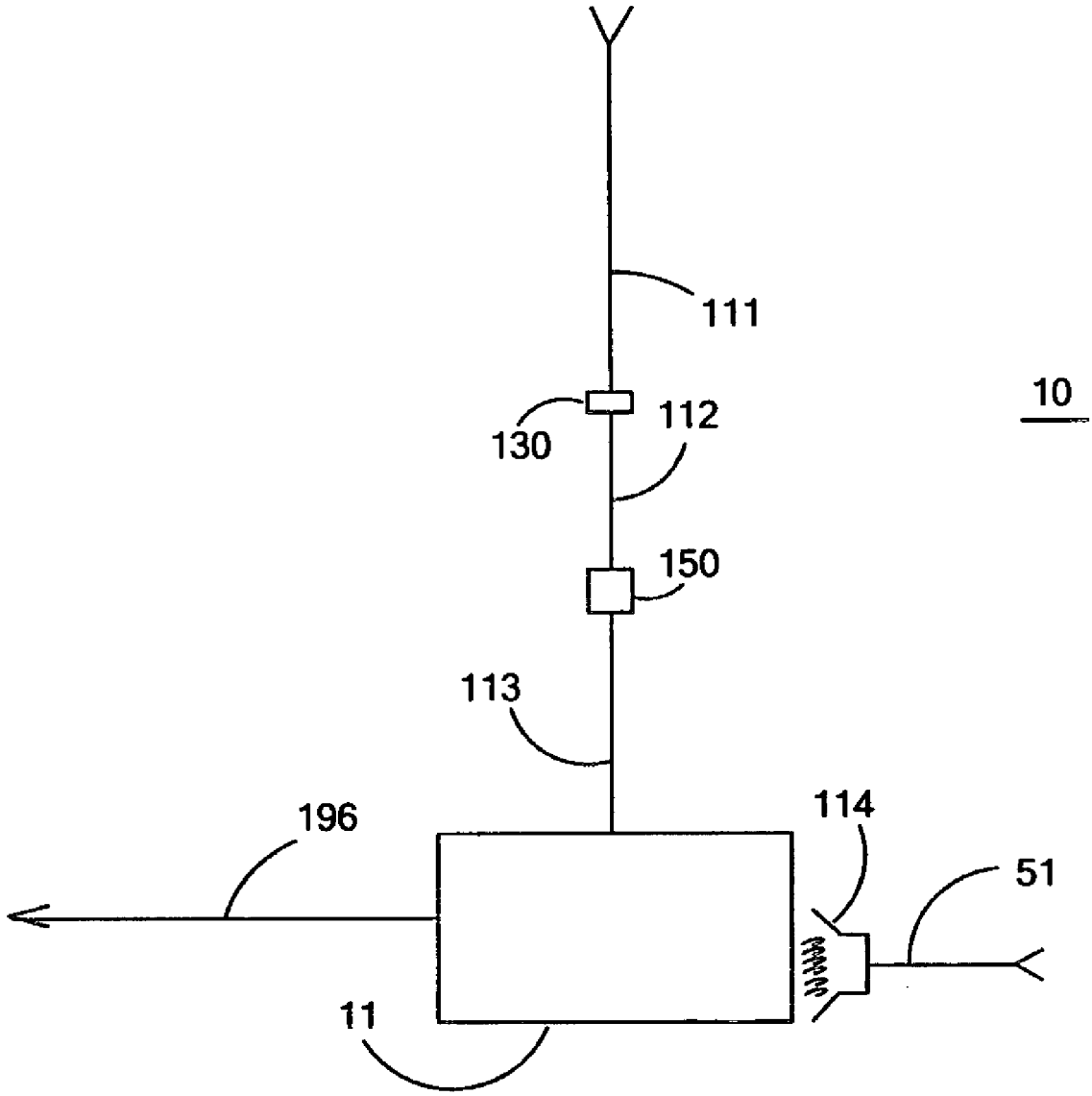
FIG. 2 is a block diagram of the apparatus 10 which disposes of the excess fresh water generated by the system 100 as steam.

FIG. 2 is a block diagram of the apparatus 10 of the instant invention. The apparatus 10, as depicted in FIG. 2, comprises in gross partition a fluid communication line 111 which provides fresh water into the input water flow meter 130, a fluid communication line 112 which communicates the fresh water output of the input water flow meter 130 to the input of the water filter system 130, a fluid communication line 113 which communicates the fresh water output of the water filter system 130 to the input of the high efficiency evaporator 11, a heat energy source 114 which is in heat communication with the high efficiency evaporator 11, an input fuel line 51 which provides fuel to the input of the heat energy source 114, and an evaporated water output line 196 which discharges steam from the high efficiency evaporator 11 into the atmosphere.

Figure 3:
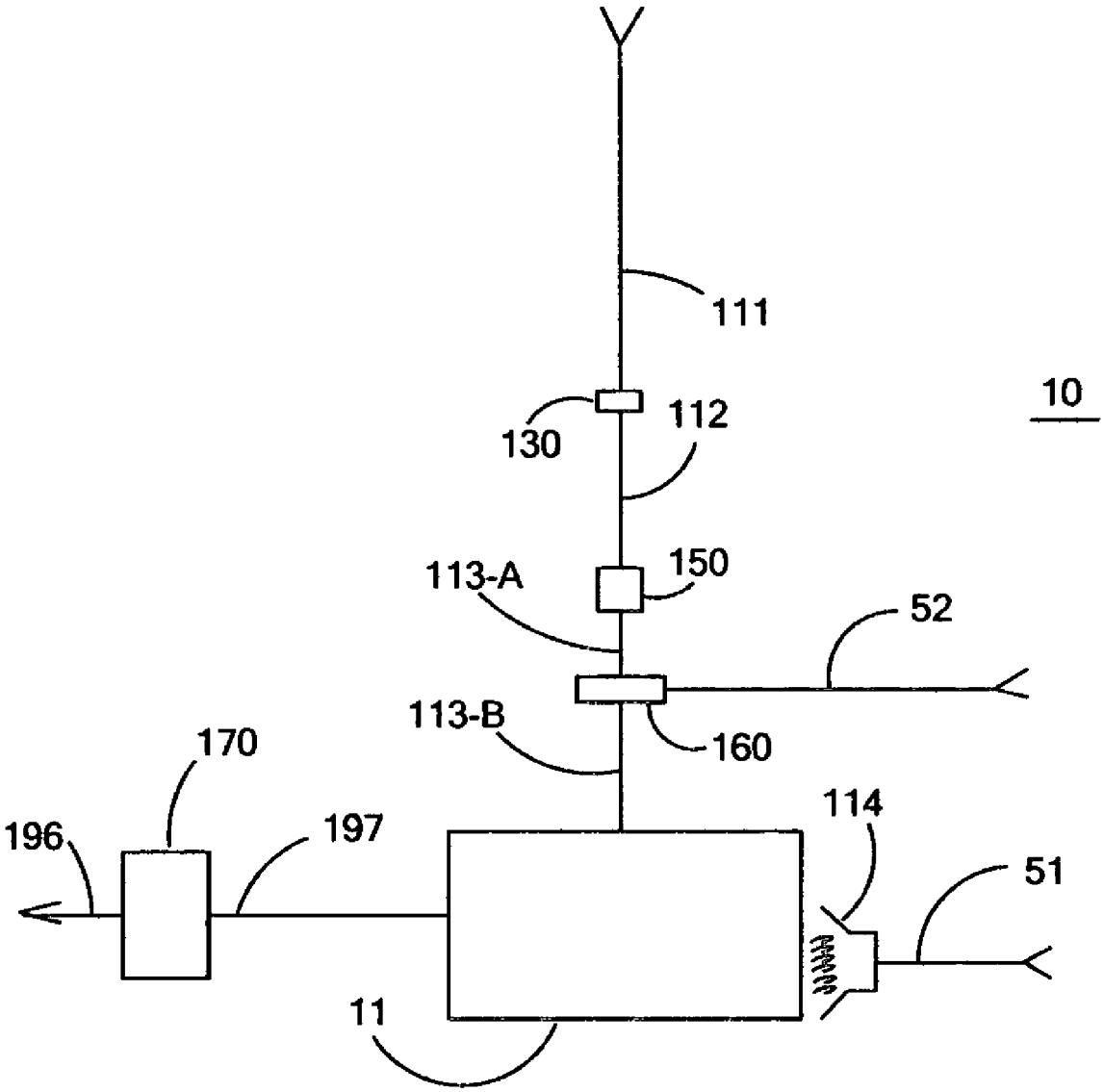
FIG. 3 is a block diagram of the apparatus 10 which includes the optional pre-heater 160 and mineral separator 170 units.

In greater particularity, and with continuing reference to FIG. 2 as well as to FIG. 3, the apparatus 10 receives fresh water from the water storage tank 20 via the fluid communication line 111. The fresh water received by the apparatus 10 through fluid flow line 111 is first metered by the input water flow meter 130 and then output from the input water flow meter 130 through fluid communication line 112 to the water filtering system 150. The output water flow of the water filtering system 150 is communicated via fluid communication line 113 to the input of the high efficiency evaporator unit 11. The output of the high efficiency evaporator unit 11 is steam or water saturated vapor and is output to the atmosphere via the evaporated water output line 196.

Optionally, as depicted in FIG. 3, the output water flow of the water filtering system 150 is communicated via fluid communication line 113*a* to the input of a pre-heater 160. Further, if the optional pre-heater 160 is utilized, the pre-heated fresh water output of the pre-heater 160 is output through fluid communication line 113*b* to the input of the high efficiency evaporator 11. Note that the optional pre-heater 160 has a fuel input line 52. The actual input fuel fed into fuel input line 52 can be any one of various hydrocarbon based, electrical, mechanical, chemical, or nuclear fuels; for example natural gas, diesel, oil, coal slurry, solar, wind or nuclear sourced electrical, mechanical shaft rotation or vibration, or other depleteable or expendable energy source material. Likewise, the input fuel fed into fuel input line 51 can be any one of various hydrocarbon based, electrical, mechanical, chemical, or nuclear fuels; for example natural gas, diesel, oil, coal slurry, solar, wind or nuclear sourced electrical, mechanical shaft rotation or vibration, or other consumable, depleteable or expendable energy source material. The energy source material into fuel input lines 51 and 52 is converted to heat energy by the heat energy source 114 or the pre-heater 160, respectively. The energy source material into fuel input line 51 need not be the same as the energy source material into fuel input line 52. Various sources of energy source material for fuel input line 52 are anticipated. For example, the energy source material for fuel input line 52 might be hot water circulated from the outer jacket of the high efficiency water evaporator unit 11, creating greater efficiency by feedback of lost heat energy. The heat energy created by the pre-heater 160 and the heat energy source 114 is imparted to the fresh water fluid flow through the apparatus 10 which fresh water fluid flow ultimately flows out of the high efficiency evaporator unit 11 into the evaporated water output line 196 as steam. The heat energy source 114 is in heat transfer communication with the high efficiency evaporator unit 11. The heat transfer mechanism may be as radiant heat, conductive heat or convective heat. The heat energy source 114 serves to efficiently extract heat energy from the energy supply input through the fuel input line 51 and transfer that heat energy into the high efficiency evaporator unit 11. The high efficiency evaporator unit 11 transfers heat energy into the fresh water flowing into the high efficiency evaporator unit 11 via fluid communication line 113*b* and flowing out of the high efficiency evaporator unit 11 via evaporated water output line 197.

Further, optionally, the evaporated water output line 197 may be connected to the input of the mineral separator system 170. The output of the mineral separator system 170 is via the de-mineralized evaporated water output line 196 and is then discharged into the atmosphere. The mineral separator system 170 takes the flow of steam or evaporated water out of the high efficiency water evaporator 11 and, by means of impacting such flow onto a series of mechanical baffles (not depicted) or otherwise, separates the mineral content from the flow of steam or evaporated water before the flow of steam or evaporated water is exhausted into the atmosphere.

Economic Benefit Statement

Economically, the instant invention provides certain advantages as a solution to the petroleum industry's problem of disposing of water produced at the wellhead. A current limitation on the production of natural gas fields in the Rocky Mountain region is the volumetric limitations on the disposal of co-produced freshwater from the gas wells. Such limitations are on the volume of water that can be re-injected into the field without affecting the groundwater tables and on the volume of water that can be added to the local surface water flows without environmentally impacting the areas surrounding the fields. Thus, increasing the volume of available freshwater disposal from natural gas fields in the Rocky Mountain region would have a substantial impact on the available increases in natural gas production. The simplicity and combination of well-known technologies provided by this invention creates a reliable, proficient, and efficient, workable method of increasing available natural gas production. Increased natural gas production will serve to make available energy at a lower overall cost and will help support the growth of the economy.

CONCLUSION

While the preferred embodiments of the method and apparatus of the instant invention 10 have been described in substantial detail and fully and completely hereinabove, it will be apparent to one skilled in the art that numerous variations of the instant invention 10 may be made without departing from the spirit and scope of the instant invention 10, and accordingly the instant invention 10 is to be limited only by the following claims.

What is claimed is:

1. A method of disposing of water produced by a hydrocarbon well comprising the steps of:

receiving the water produced by the hydrocarbon well, filtering the water to produce filtered water, applying heat from a heat energy source to heat an enclosed water heating unit, inputting the filtered water to the enclosed water heating unit, heating the filtered water in the enclosed water heating unit to create water saturated vapor, releasing minerals from the water saturated vapor in a mineral separation unit, and exhausting the water saturated vapor into the atmosphere.

2. The method of claim 1 additionally comprising the step of:

preheating the filtered water in a preheating unit before inputting the filtered water to the water heating unit, said preheating step utilizing exhaust heat from the heat energy source to preheat the filtered water.

3. An apparatus for disposing of water produced from the wellhead of a hydrocarbon well, said apparatus comprising:

a water filter system, an input water flow metering system, a heat energy source, a water heating system; and a mineral separation system wherein the water is input to the water filter system, the output of the water filter system is in fluid flow communication with the input of the input water flow metering system, the output of the input water flow metering system is in fluid flow communication with the input of the water heating system, said heat energy source is in heat transfer communication with the water heating system, and the mineral separation system receives the high pressure superheated water from the water heating system and reduces the pressure, thereby causing the superheated water to flash to steam and release minerals;

wherein the water heating system heats the filtered water to generate high pressure superheated water, and said superheated water flashes to steam when the superheated water is output from the mineral separation system to the atmosphere.

4. The apparatus of claim 3 additionally comprising a pre-heater wherein the input of said pre-heater is in fluid communication with the output of the input water flow metering system, and the output of said pre-heater is in fluid communication with the input of the water heating system.

5. An Apparatus for disposing of water produced by a hydrocarbon well, said apparatus comprising:

means for receiving the water produced by the hydrocarbon well, means connected to the receiving means for filtering the received water to produce filtered water, means connected to the filtering means for receiving the filtered water and heating the filtered water to create high pressure superheated water or water saturated vapor, said water heating means including:

a heat energy source, and heat transfer means for transferring heat from the heat energy source to the filtered water, means for separating minerals from the superheated water or water saturated vapor, and means for exhausting the high pressure superheated water or water saturated vapor into the atmosphere, wherein the high pressure superheated water flashes to steam when the pressure is reduced by the exhausting means.

6. The apparatus of claim 5, wherein the heat energy source is selected from a group consisting of:

a hydrocarbon-based fuel, electrical energy, mechanical energy, chemical energy, and nuclear fuel.

* * * * *